United States Patent [19]

Naumann et al.

[11] 4,023,311

[45] May 17, 1977

[54] DEVICE FOR FINE HONING CRANKSHAFTS

[75] Inventors: Wilhelm Naumann, Cologne; Wolfgang Littmann, Ranzel; Rudolf Aussem, Hennef, all of Germany

[73] Assignee: Klockner-Humboldt-Deutz Aktiengesellschaft, Cologne, Germany

[22] Filed: Apr. 10, 1975

[21] Appl. No.: 566,684

[30] Foreign Application Priority Data

Apr. 11, 1974 Germany ..... 2417725

[52] U.S. Cl. ..... 51/31; 51/47; 51/73 GC

[51] Int. Cl.[2] ..... B24B 5/42

[58] Field of Search ..... 51/34 R, 34 C–34 G, 51/47, 67, 68, 73 R, 73 GC, 31

[56] References Cited

UNITED STATES PATENTS

| | | | |
|---|---|---|---|
| 1,462,979 | 7/1923 | Petersen | 51/73 GC |
| 1,928,506 | 9/1933 | Sellberg | 51/73 GC |
| 2,138,258 | 11/1938 | Sievers | 51/73 GC |
| 2,162,187 | 6/1939 | Tharp | 51/73 GC |
| 2,245,435 | 6/1941 | Dondineau | 51/73 GC X |
| 2,291,164 | 7/1942 | Law | 51/73 GC X |
| 2,502,381 | 3/1950 | Indge | 51/73 GC |
| 3,548,547 | 12/1970 | Runge | 51/67 |
| 3,808,745 | 5/1974 | Belohoubek | 51/73 GC X |

*Primary Examiner*—Harold D. Whitehead
*Assistant Examiner*—Nicholas P. Godici
*Attorney, Agent, or Firm*—Walter Becker

[57] ABSTRACT

A device for fine honing cylindrical surfaces, such as the bearings of a crankshaft, in which the surface is stationarily supported while an annular tool holder separable along a diameter is disposed around the surface. The tool holder has housing elements therein and is rotated about the axis of the surface while being oscillated in a direction parallel to the axis. The tool holder is rotatable in a housing which is also separable along a diameter of the tool holder while the housing is supported for adjustable positioning to align the tool holder with the surface.

19 Claims, 10 Drawing Figures

FIG. 5
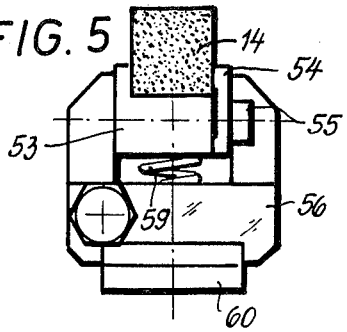
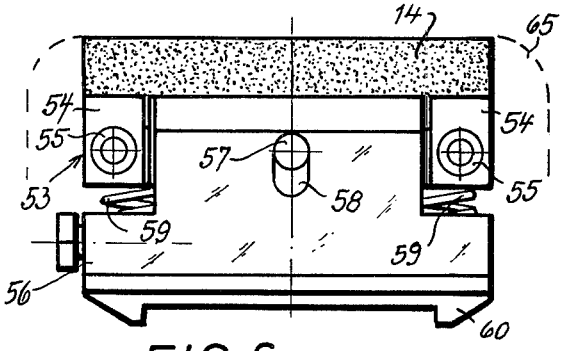
FIG. 6
FIG. 7
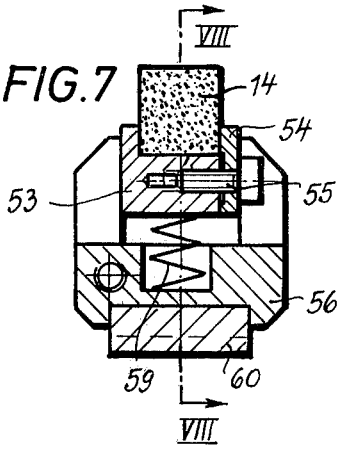
FIG. 8
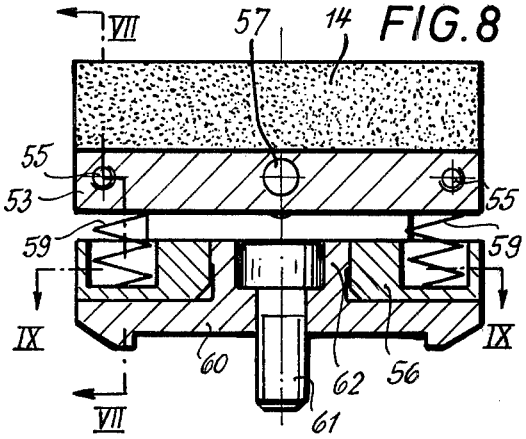
FIG. 9
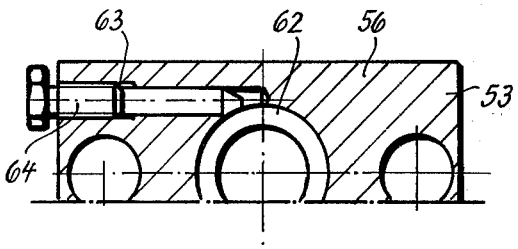
FIG. 10
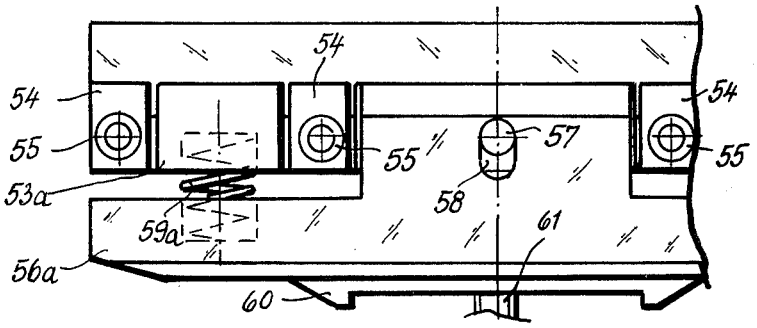

DEVICE FOR FINE HONING CRANKSHAFTS

The present invention relates to a device for fine honing of substantially cylindrical surfaces, especially of crank pins of eccentric shafts and crankshafts of reciprocable piston internal combustion engines, in which a working movement occurs in axial and in circumferential direction between the honing tool or tools and the cylindrical surface.

Fine honing machines are known in which the crankshaft rotates and in which the tool holders extend at least around the crank pin to be machined and slide or roll on the crank pin. The tool holders comprise a honing tool with a drive which reciprocates the grinding tools in the axial direction of the pins whereby in cooperation with the circumferential movement of the crank pin the desired fine honing effect in axial and circumferential direction is effected. Inasmush as for purposes of obtaining a good surface in axial and circumferential direction of the pin, a certain relative speed between the grinding tool or honing stone and the surface to be machined is necessary in axial and circumferential direction of the pin, these machines will work satisfactorily when crankshafts of smaller dimensions and lower weight are involved. With larger crankshafts, this is not the case because in such an instance due to the masses being moved and the limited journaling possibility, it is not possible to cause the crankshafts to rotate sufficiently fast so that a sufficient surface quality can be obtained in axial direction only but not in the circumferential direction of the pin. As a result thereof, increased bearing wear and destruction of the bearing will be the result.

It is, therefore, an object of the present invention to provide a device for fine honing which also with large and very large crankshafts will yield satisfactory results.

It is a further object of this invention to provide a device as set forth in the preceding paragraph which will be relatively inexpensive to produce and which can easily be operated.

These and other objects and advantages of the invention will appear more clearly from the following specification in connection with the accompanying drawings, in which:

FIGS. 5 and 6 represent side views of a tool holding device.

FIG. 7 is a section taken along the line VII—VII of FIG. 8 through the tool holding device in FIGS. 5 and 6.

FIG. 8 shows a section through the same tool holding device along the line VIII—VIII of FIG. 7.

FIG. 9 represents a section along the line IX—IX of FIG. 8 through the tool holding device.

FIG. 10 is a side view of the modified tool holding device according to the invention.

Figure 1:
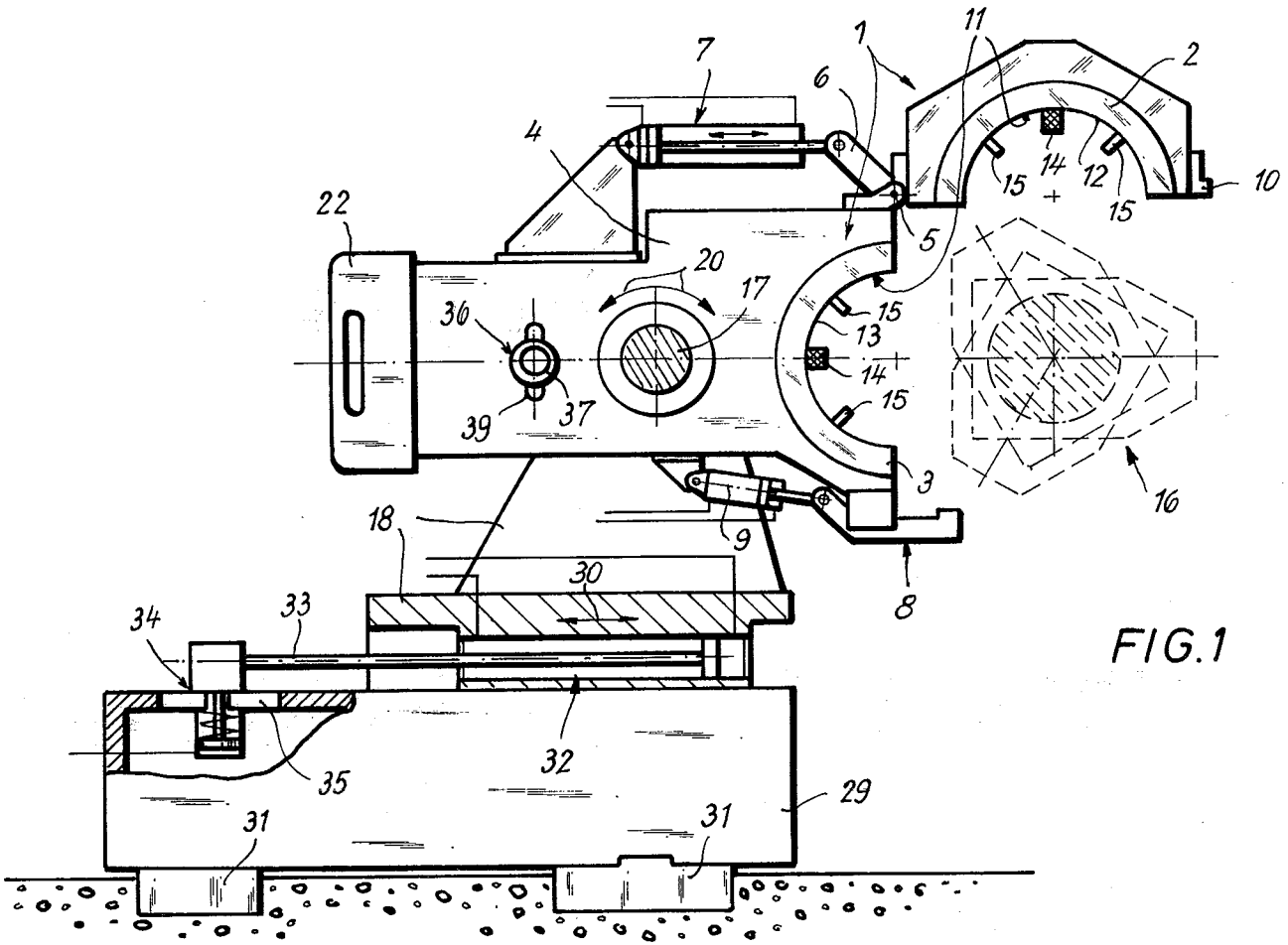
FIG. 1 is a side view of a fine honing device according to the invention with sections through the axis of the rocker, the machine frame, and the machine table.

The device for fine honing of substantially cylindrical surfaces, according to the present invention, is characterized primarily in that the tool holder receiving and holding the fine honing tools is rotatably journalled in an annular housing, and is furthermore characterized in that said annular housing and/or the crankshaft are movable axially parallelly with regard to the crank pin while the crankshaft is non-rotatably mounted during the fine honing.

This device is based on the idea of causing a component of the honing tool to be effective in circumferential direction by rotating the tool about the pin, whereas the axial component of the honing direction is brought about by a transverse movement of the grinding tool or the crankshaft inasmuch as this movement requires a shorter stroke and a lower speed. A possible further improvement of the invention consists in that the annular housing is divided radially while one part is pivotally mounted for opening the ring and is arrested in its closing position. Furthermore, the tool holder is designed as an annular member and has a corresponding radial calibration. The annular housing and the annular tool holder is opened for purposes of embracing the crank pin and is subsequently closed. The tool holder will then similar to a rigid ring rotate in the housing and will be able precisely to follow the pin. The tool holder and the annular housing have cooperating bearing surfaces while the bearing surfaces of the annular housing have sockets subjected to the influence of pressure means by which the tool holder is substantially hydrostatically guided, and while the tool holder has a gear ring by means of which the tool holder is driven. This hydrostatic mounting of the tool holder is advantageous particularly when the tool holder comprises two annular sections, because also a slight offset of the annular sections due to the guiding in pressure fluid can be tolerated by the mounting without damage. Furthermore, the hydrostatic mounting permits any desired high circumferential speeds so that the device can easily be adapted to pin diameters of different sizes. The hydrostatic mounting wears only slightly because during the rotation of the annular tool holder, practically no contact between the bearing surfaces occurs so that also after a long period of use a precise guiding of the tool holder is maintained and a high honing quality will be assured.

According to a further development of the invention, it is suggested that the fluid pressure pockets are individually or in pairs connected to a pressure fluid conduit while in the pressure fluid conduit there is installed an adjustable throttle. This design makes it possible in a similar manner so to provide the pockets with a pressure medium that everywhere a uniform pressure will prevail. Furthermore, due to the fact that for instance when the meeting areas of the two ring sections of the tool holders pass by said pocket, a brief pressure drop will not become effective with regard to the other pockets. A good guiding of the tool holder in radial as well as in axial direction will be assured due to the fact that the bearing surfaces are arranged laterally and comprise each two annular sections which are arranged in an angle relative to each other. As a result thereof, viewed in a radial section through the tool holder and the annular housing, lateral protrusions will be obtained which engage recesses in the tool holder. By a simple axial adjustment of these protrusions, it is therefore possible in a simple manner to control the play between the bearing surfaces. The hydrostatic mounting may be so designed that the hydrostatic fluid medium which leaves the bearing surfaces of the annular housing serves the honing tools as honing liquid. As a result thereof, a separate supply of honing liquid to the fine honing tools is not necessary. In order to simplify the handling of the machine, it is furthermore suggested that the annular housing comprise a feed initiator, for instance an inductive front pulse emitter, which controls the drive of the tool holder in such a way that the dividing plane of the annular housing and of the tool holder will substantially coincide when the tool holder is at a standstill. As a result thereof, no special attention has to be paid to the position of the tool holder in the annular housing prior to the opening of the latter, because during the standstill there exists always a correct position. A post-rotation of the drive, for instance by hand, is not necessary. In order in unfolded condition to prevent an annular part of the tool holder from dropping out, it is suggested that every part of the annular housing has at least one spring loaded clamping lever, while said clamping levers are operatively connected to the arresting of the annular housing and in non-arrested condition clamp the parts of the tool holder within the annular housing parts. It is furthermore suggested that the annular housing is connected to a rocker which is pivotable in a machine frame and is displaceably mounted for parallel displacement with regard to the eccentric and crank pin axes. The pivoting movement makes it possible that crank pins can in various positions be fine honed without turning the crankshaft. Furthermore, due to the fact that the annular housing is connected to a rocker and that said rocker is displaceably mounted for displacement parallel to the pin axis, it is possible in an advantageous manner to keep the crankshaft during its entire machining operation absolutely non-movable. Consequently, also particularly heavy crankshafts can be machined. The displacement movement of the rocker is in an advantageous manner effected by a displacment drive which is mounted in the machine frame preferably in the form of an eccentric drive and includes a feed initiator which cooperates with the displacement drive and which stops the rocker drive in such a way that the rocker will when at a standstill occupy its central position. In order to realize an easily movable but nevertheless precise mounting of the rocker, it is suggested that the rocker has a shaft which is journalled in the machine frame by means of rows of balls. In this way, it will be assured that the pivoting as well as the displacement movement can be effected without slide friction. Furthermore, it is suggested that the rocker including a hollow chamber between the annular housing and the axle and that the axle has at least partially a bore through which the drive may be effected as usual through the intervention of gears or chains. The machine frame in its turn is displaceably and arrestably mounted on a machine table at a right angle to the eccentric or crank pin shaft. As a result thereof, the entire machine frame can with the annular housing in open condition be easily displaced from its resting position to its working position and vice versa. The machine frame has an adjusting cylinder the free end of which is in the displacement direction of the machine frame movably mounted on the machine table and is adapted to be arrested by a clamping cylinder. As a result thereof, it is possible without absolutely limiting the movability of the machine frame to obtain a fixed arresting thereof. A control device can therefore be associated with the adjusting cylinder of the machine frame, which control device will bring about a return of the adjusting cylinder to a previously ascertained and registered position. This makes it possible in an advantageous manner to adjust for instance the tool holder in its working position while the annular housing will be opened, the machine frame will be returned, and by returning the adjusting cylinder, the previously adjusted position of the machine frame will be obtained.

It is furthermore suggested that between the machine frame and the rocker a fixing device with a clamping cylinder be provided by means of which the pivoting movement of the rocker can be arrested. That portion of the clamping cylinder which cooperates with the rocker is movably journalled in the rocker in the direction of displacement of the rocker. Due to this design, it is now possible to arrest the rocker in any desired pivoted position and thus to move the rocker into its working position in any desired position of the rocker. This mounting may likewise be effected in conformity with a mounting of the axle of the rocker by means of rows of balls. In order to be able without changing the position of the crankshaft to fine hone all pins, it is suggested that the machine table is adjustable parallel to the longitudinal axis of the crankshaft and is arrestably mounted. Furthermore in order to be able to adjust the tool holder precisely in alignment with the crank pin, it is suggested that within the tool holder aligning elements are connectable which with the annular housing in closed position extend around the eccentric or crank pins. For purposes of aligning, all arresting means and fixing means of the device are relieved. After completion of the aligning operation as well as during the honing, all arresting and fixing devices are effective. In this way, it is possible freely to move the rocker, the machine frame, and the machine table relative to the crank pin so that a precise adjustment can be effected. In order to facilitate the pivoting of the rocker and to relieve the fixing device for the rocker, it is suggested that that end of the rocker which is opposite to the end of the annular housing is provided with a counterweight for establishing equilibrium around the axle.

Figure 2:
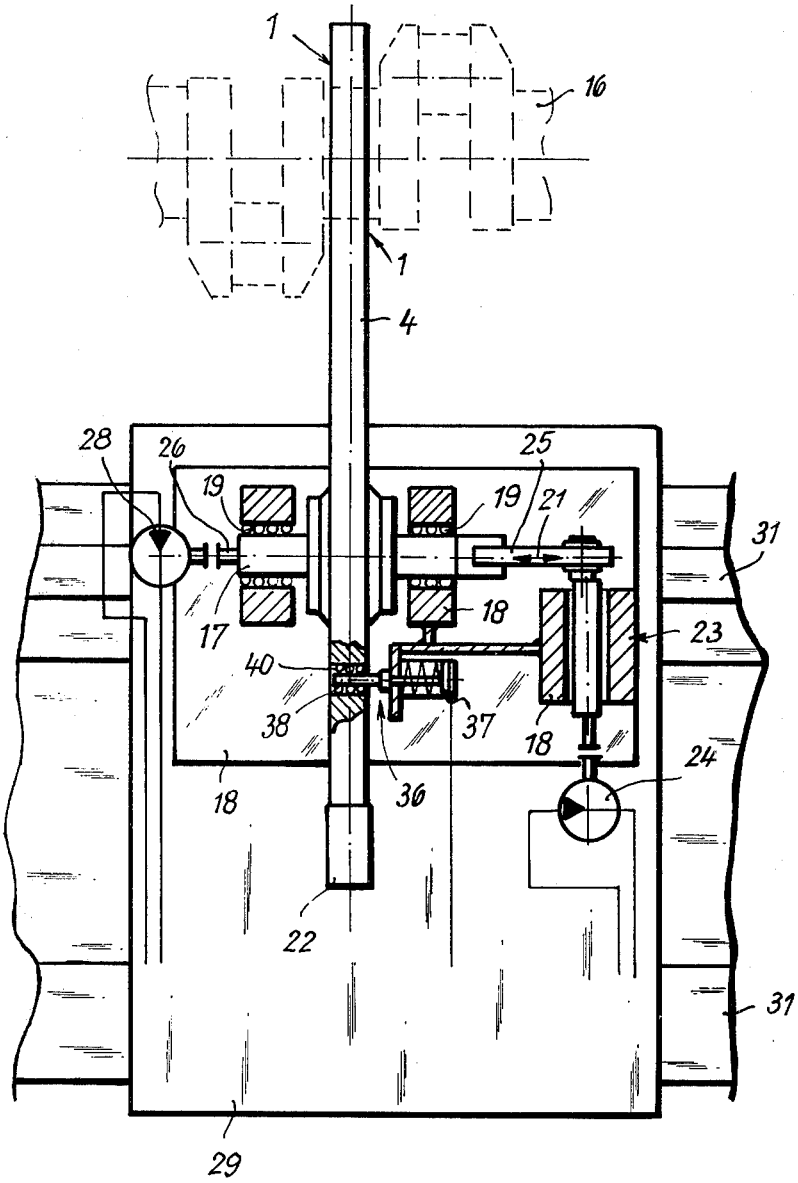
FIG. 2 is a top view of the device according to the invention with a partial section through the machine frame.

Referring now to the drawings in detail, and FIGS. 1–4 in particular, the arrangement shown therein includes an annular housing 1 which comprises two sections 2 and 3. The section 3 is connected to a rocker 4. Mounted on the rocker 4 is a joint 5 on which the part 2 of the annular housing is pivotable about a horizontal axis. Non-rotatably connected to the section 2 is a lever 6 the outer end of which leads to a lifting cylinder 7 connected to the rocker 4. Therefore, the pivot movement of the section 2 is effected by actuation of the lifting cylinder 7. That lower end of the rocker 4 which is opposite to the joint 5 is provided with an arresting device 8 which can likewise be acutated by a cylinder piston system 9 connected to the rocker. The arresting device 8 cooperates with a protrusion 10 which is connected to the section 2 so that after folding downwardly the section 2, a fixed clamping between the section 2 and 3 by the arresting device 8 can be effected by means of the cylinder piston system 7. Within the annular housing 1 there is mounted an annular tool holder 11 which likewise comprises two sections 12 and 13 and has the same calibration as the annular housing 1. To the inner side of the tool holder 11 are connected fine honing tools or honing stones 14. Furthermore, as illustrated in FIG. 1, aligning elements 15 may be provided on the tool holder inner surface. The aligning elements 15 serve for aligning the entire device relative to the crank pin to be honed so that a uniform fine honing will be effected. To this end, the aligning elements are employed and the rocker is moved to the respective pin, and the annular housing 1 is closed. For a more detailed explanation, reference may be had to the crankshaft which in FIGS. 1 and 2 is shown in dash lines.

The rocker 4 has an axle 17 by means of which the rocker is journalled in a machine frame 18. As will be seen in particular from FIG. 2, the journalling is effected by means of ball rows 19 so that an easily movable and precise mounting, also permitting displacement movements, will exist. The arrows 20 in FIG. 1 indicate a possible pivoting movement of the rocker, and the arrows 21 in FIG. 2 indicate displacement movement of the rocker. Furthermore, the rocker has that end thereof which is located opposite to the ring housing 1 provided with a counterweight 22. This counterweight 22 is so dimensioned that an equilibrium about the axle 17 is established.

As will be evident from FIG. 2, an eccentric drive 23 is connected to the machine frame 18 and has a hydrometer 24 associated therewith. The eccentric drive is through a connecting rod 25 connected to the axle 17 so that a rotary movement of the eccentric drive brings about a displacement movement of the entire rocker 4. Furthermore, as will also be seen from FIG. 2, the axle 17 has at that side thereof which is opposite to the eccentric drive 23, a bore in which a shaft 26 is journalled. The shaft 26 leads into a hollow space or chamber of the rocker in which by means of gears 27 (FIG. 3) the tool holder 11 is driven. The shaft 26 in its turn is coupled to a hydromotor 28. The machine frame is mounted on a machine table 29 and is displaceable in the direction of the arrows 30 in FIG. 1.

The machine table 29 rests on rails 31 and is displaceable thereon in a direction axis-parallel to the crankshaft 16. An easy movement is obtained by a pneumatic mounting. The machine frame 18 furthermore comprises an adjusting cylinder 32 illustrated in FIG. 1. The free end of the connecting rod 33 is connected to a cocking or clamping cylinder 34. The cylinder 34 is so arranged in oblong hole 35 of the machine table 29 that it is displaceable in the direction of the arrows 30 but can be clamped to the machine frame in any desired position within the oblong hole. The adjusting cylinder 32 has associated therewith a non-illustrated control device which cooperates for instance with an adjusting abutment acting between the machine frame and the machine table so that after adjusting the annular housing 1 about a pivot of the crankshaft 16 the annular housing 1 is opened by the aligning elements 15, and the machine frame can in the direction of one of the arrows 30 be moved away from the crankshaft and after removal of the aligning elements 15 can again be returned to its old position.

Furthermore, the machine frame 18 has a fixing or arresting device 36 (FIG. 2) with a clamping cylinder 37. Cylinder 37 is guided in an oblong hole 39 (FIG. 1) of the machine frame 18 and can be arrested in any desired position of said oblong hole. The cylinder 37 comprises a pin 38 which extends into the rocker 4 where it is mounted so as to be movable in the direction of the arrows 21 by means of rows of balls 40. Due to the fixing or arresting device it is possible to fix the rocker in any desired pivoting position while after relieving the clamping cylinder 37, free movability is assured. Also in fixed position the displacement movement of the entire rocker between the arrows 21 is possible.

Operatively connected to the eccentric drive 23 is a feed initiator (not illustrated) which dominates the drive of the hydromotor 24 in such a way that the eccentric drive stops in such a position that the rocker 4 will occupy an intermediate position of its displacement movement in conformity with the arrows 21.

Figure 3:
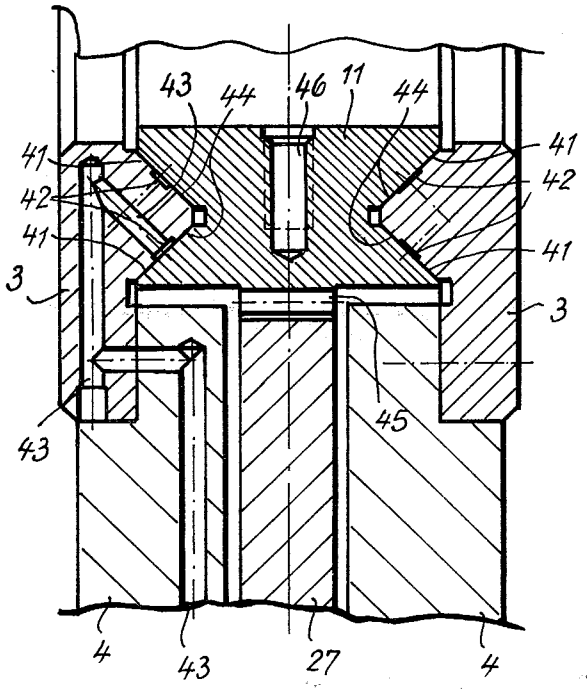
FIG. 3 is a partial section through the rocker, the annular housing, and the tool holder.

As will be evident in particular from FIG. 3 which represents a section in radial direction through the annular housing part 3 and the tool holder 11, the annular housing has four bearing surfaces 41 each two of which are arranged on each side of the tool holder. The bearing surfaces of each side which if desired may be designed as annular surfaces are arranged relative to each other at an angle of 90° and include pockets 42 worked into the bearing surfaces. These pockets are through conduits 43 connected to sources of pressure media. Adjustable throttles (not illustrated) are interposed in said conduits 43 so that in all pockets the same hydraulic pressure can be adjusted. The said throttles have associated therewith measuring gauges by means of which the pressure can be ascertained. The tool holder 11 has bearing surfaces 44 which correspond to the bearing surfaces 41 and which during the operation of the device cooperate with the pressure in the pockets 42 in such a way that the hydraulic guiding of the tool holder is effected. Furthermore, the tool holder is equipped with an outer gear ring 45 which when viewing from shaft 25 meshes with the last gear of the gears 27. The tool holder has its inner surface provided with a plurality of threaded blind bores 46 by means of which the tool holding devices and aligning elements 15, referred to below in detail, can be connected.

Figure 4:
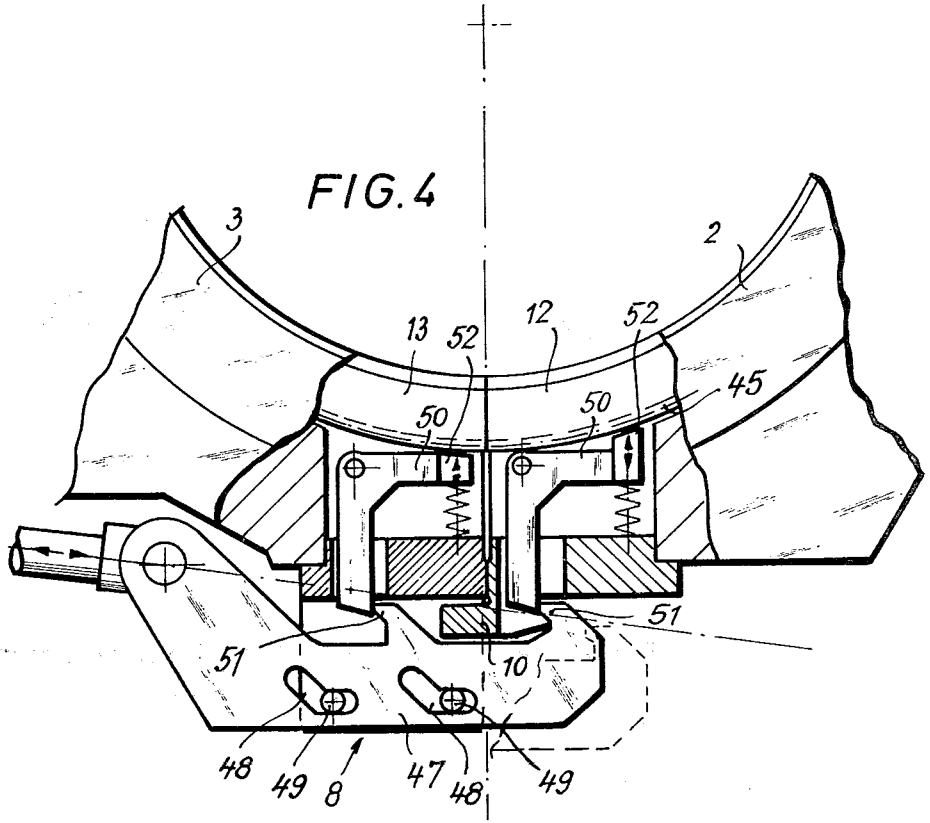
FIG. 4 is a partial section through the annular housing in which the arresting device of the annular housing and the clamping levers are visible.

As will be evident from FIG. 4, the arresting device 8 has a head 47 which cooperates with the above described protrusion 10 on the housing part 2. The head 47 is by means of contour oblong holes 48 in a bolt 49 connected to the housing part 3 guided in such a way that in response to the actuation of the lifting cylinder 9 in opening direction, the head 47 is additionally also moved outwardly. Mounted on the annular housing part 2 and on the annular housing part 3 are one spring urged clamping lever 50 each which have one end thereof protrude from the housing parts and cooperate with noses 51 on the head 47. When the head 47 occupies a position in which the housing part 2 is not arrested, the clamping levers 50 are under spring force and clamp by means of heads 51 connected thereto by parts 12 and 13 within the annular housing 1 so that said parts will be arrested. This brings about that when opening the annular housing 1, the parts 12 and 13 of the tool holder 11 cannot drop out. Operatively connected to the tool holder 11 is an inductive front impulse emitter (Stirnimpulsgeber) which controls the hydromotor 28 in such a way that the tool holder 11 is stopped in such a position that the parts 12 and 13 are arranged substantially entirely in the annular housing parts 2 and 3.

As will be seen from FIGS. 5-9, the tool holding device comprises a clamping part 53 in which the fine honing tool 14 or the honing stone is connected. To this end, plates 54 are arranged at the outer ends of the clamping part 53 and are by means of screws 55 adapted to be clamped in the direction of the honing tool. The clamping part 53 is displaceably mounted in a guiding body 56 and is secured through the intervention of a bolt 57 which engages the oblong holes 58 of the guiding body. Between the guiding body 56 and the clamping part 53, pressure springs 59 are arranged which urge the clamping body in a direction away from the guiding body. The guiding body 56 in its turn is mounted on a transition member 60 which by means of a screw 61 is connected to the tool holder 11 (not illustrated) in FIGS. 5-9. For receiving the guiding body 56, the member 60 has a cylindrical head 62 which corresponds to a corresponding bore in the guiding body. In the guiding body 56 there is furthermore arranged a threaded blind bore 63 and a corresponding screw 64 in such a way that the tip of the screw tangentially engages the cylindrical head 62 and thus clamps fast the guiding body against the member 60 or cylinder head 62. The shape illustrated in FIG. 6 by a dash line 65 indicates the contour of an eccentric or crank pin.

The tool holding device illustrated in FIG. 10 substantially corresponds to the tool holding device according to FIGS. 5-9 but has a greater width for honing longer pin contours. To this end, the guiding body 56*a* is extended toward both sides. The clamping member 53*a* has a length which corresponds to that of the guiding body 56*a* and on each end has two plates 54 each. Otherwise, the construction of the tool holding device according to FIG. 10 corresponds to that of FIGS. 5-9.

It is, of course, to be understood that the present invention is, by no means, limited to the specific showing in the drawings, but also comprises any modifications within the scope of the appended claims.

What is claimed is:

1. A device for the fine honing of a substantially cylindrical surface, especially a crankshaft bearing, which comprises; a support, a frame slidable on the support in a direction at right angles to the axis of the surface to be machined, a housing pivotally mounted on the support on an axis parallel to the axis of the surface to be machined, an annular tool holder rotatable in the housing and adapted to support radially inwardly directed honing means therein and also adapted to receive a cylindrical surface to be honed therein and on the axis of rotation thereof, means for driving said tool holder and the surface to be machined in relative rotation, means for oscillating said tool holder and surface to be machined in relative axial reciprocation, the surface to be machined being nonrotatably supported during the honing thereof, the tool holder and housing comprising cooperating bearing surfaces, the bearing surfaces in the housing having pockets formed therein opening toward the bearing surfaces on the tool holder, and means for supplying fluid under pressure to said pockets, said means for driving the tool holder in rotation comprising a gear ring mounted thereon.

2. A device according to claim 1 in which both said housing and tool holder are divided into two parts along a diameter thereof, means pivotally interconnecting the parts of the housing at one side and means for detachably holding the parts of the housing together on the other side.

3. A device according to claim 1 which includes a source of pressure fluid for supplying pressure to said pockets, and adjustable throttle means interposed between the source of pressure fluid and said pockets.

4. A device according to claim 1 in which said bearing surfaces comprise inclined annular bearing surfaces arranged angularly to each other.

5. A device according to claim 3 in which the said fluid is a hydraulic medium and the hydraulic medium which escapes from the bearing surfaces is supplied as a honing fluid for the honing tools engaging the cylindrical surface being honed.

6. A device according to claim 1 which includes a rocker pivoted on said frame and supporting said housing.

7. A device according to claim 1 in which said support and frame comprise cooperating elements of guide means perpendicular to the plane of the axis of the cylindrical surface being honed.

8. A device according to claim 7 which includes an adjusting cylinder in said frame parallel to said guide means, and a piston in the cylinder having a rod extending from the cylinder, and means for clamping the free end of the rod in adjusted position to said support.

9. A device according to claim 8 which includes means for locating said piston in a predetermined position in said cylinder.

10. A device according to claim 1 in which said support is movable in a direction parallel to the axis of rotation of the tool holder.

11. A device according to claim 1 which includes alignment elements in said tool holder engageable with the surface to be honed to align the tool holder with the surface, and means for fixing said frame and housing in aligned position for a honing operation.

12. A device according to claim 1 in which the surfaces to be honed comprise at least one of the pin and line bearings of a crankshaft.

13. A device for the fine honing of a substantially cylindrical surface, especially a crankshaft bearing, which comprises; a support, a frame slidable on the support in a direction at right angles to the axis of the surface to be machined, a housing pivotally mounted on the support on an axis parallel to the axis of the surface to be machined, an annular tool holder rotatable in the housing and adapted to support radially inwardly directed honing means therein and also adapted to receive a cylindrical surface to be honed therein and on the axis of rotation thereof, means for driving said tool holder and the surface to be machined in relative rotation, means for oscillating said tool holder and surface to be machined in relative axial reciprocation, the surface to be machined being nonrotatably supported during the honing thereof, both said housing and tool holder being divided into two parts along a diameter thereof, means pivotally interconnecting the parts of the housing at one side and means for detachably holding the parts of the housing together on the other side, and pulse emitting means sensitive to the rotated position of said tool holder in said housing and operable to bolt said tool holder in rotated position in the housing wherein the planes of separation of the tool holder and housing coincide.

14. A device according to claim 13 in which the parts of said housing comprise clamp elements thereon adjacent the means for detachably holding the housing parts together and operable to clamp the parts of the tool holder in the respective parts of the housing, said clamp elements being actuated into noneffective position by said means for detachably holding housing parts when the housing parts are closed and held together.

15. A device for the fine honing of a substantially cylindrical surface, especially a crankshaft bearing, which comprises; a support, a frame slidable on the support in a direction at right angles to the axis of the surface to be machined, a housing pivotally mounted on the support on an axis parallel to the axis of the surface to be machined, an annular tool holder rotatable in the housing and adapted to support radially inwardly directed honing means therein and also adapted to receive a cylindrical surface to be honed therein and on the axis of rotation thereof, means for driving said tool holder and the surface to be machined in relative rotation, means for oscillating said tool holder and surface to be machined in relative axial reciprocation, the surface to be machined being nonrotatably supported during the honing thereof, a rocker pivoted on said frame and supporting said housing, an eccentric drive on said frame connected with said rocker for oscillating the rocker in the direction of the axis of said tool holder, and means for halting said eccentric drive with the rocker in the center of the path of oscillation thereof.

16. A device according to claim 15 which includes a support shaft for said rocker, and balls in said frame supportingly engaging said shaft while permitting axial oscillation of the shaft.

17. A device according to claim 16 in which said housing includes a chamber in the region of said shaft which opens to the tool holder, and the means for driving said tool holder in rotation extends through said chamber.

18. A device according to claim 15 which includes cooperating elements of arresting means on said rocker and frame for arresting the rocker on the frame.

19. A device according to claim 15 in which said rocker includes counterweight means thereon at the end opposite said housing.

* * * * *